US009156534B2

(12) United States Patent
Orselli

(10) Patent No.: US 9,156,534 B2
(45) Date of Patent: Oct. 13, 2015

(54) APPARATUS FOR MOVING AN OUTBOARD MOTOR INSTALLED ON A BOAT AND BOAT WITH FOLDAWAY OUTBOARD MOTOR

(75) Inventor: Andrea Orselli, Ravenna (IT)

(73) Assignee: SINER "G" S.R.L. (IT)

( * ) Notice: Subject to any disclaimer, the term of this patent is extended or adjusted under 35 U.S.C. 154(b) by 11 days.

(21) Appl. No.: 13/704,312

(22) PCT Filed: Jun. 17, 2010

(86) PCT No.: PCT/IT2010/000271

§ 371 (c)(1),
(2), (4) Date: Dec. 14, 2012

(87) PCT Pub. No.: WO2011/158263

PCT Pub. Date: Dec. 22, 2011

(65) Prior Publication Data

US 2013/0090026 A1 Apr. 11, 2013

(51) Int. Cl.

| | |
|---|---|
| ***B63H 20/08*** | (2006.01) |
| ***B63H 20/02*** | (2006.01) |
| ***B63B 7/08*** | (2006.01) |
| ***B63H 20/06*** | (2006.01) |
| *B63H 20/36* | (2006.01) |

(52) U.S. Cl.

CPC ..... *B63H 20/02* (2013.01); *B63B 7/087* (2013.01); *B63H 20/06* (2013.01); *B63H 20/08* (2013.01); *B63H 20/36* (2013.01)

(58) Field of Classification Search

USPC ..... 440/53, 63; 114/345
IPC ..... B63H 20/10; B63B 7/082
See application file for complete search history.

(56) References Cited

U.S. PATENT DOCUMENTS

| | | | | |
|---|---|---|---|---|
| 3,342,156 | A * | 9/1967 | Denys et al. | 440/63 |
| 3,948,204 | A * | 4/1976 | Brock et al. | 440/6 |
| 4,279,602 | A * | 7/1981 | Alter | 440/63 |
| 4,842,559 | A * | 6/1989 | Litjens et al. | 440/1 |
| 6,007,391 | A | 12/1999 | Eilert | |
| 6,254,441 | B1 | 7/2001 | Knight | |
| 7,244,152 | B1 | 7/2007 | Uppgard | |

FOREIGN PATENT DOCUMENTS

AU 2009225271 A1 4/2010

OTHER PUBLICATIONS

International Search Report; International Application No. PCT/IT2010/000271; International Application Filing Date Jun. 17, 2010; Mail date Jul. 4, 2011.

Written Opinion, International Application No. PCT/IT2010/000271; International Application Filing Date Jun. 17, 2010; Mail date Jul. 4, 2011.

* cited by examiner

*Primary Examiner* — Stephen Avila
(74) *Attorney, Agent, or Firm* — Cantor Colburn LLP

(57) ABSTRACT

An apparatus for moving an outboard motor installed on a watercraft of the type that comprises a transom for the stable coupling of adapted engagement elements that are jointly connected to the motor; the apparatus comprises a panel, which is articulated at least to bottom boards of the watercraft and at least partially superimposed on the transom, for the engagement of the engagement elements of the motor; the panel, by virtue of articulation elements, can move from a first configuration for navigation, in which it is partially superimposed on the transom and rigidly coupled thereto, to a second configuration for housing the watercraft, in which it is rotated substantially at right angles to the transom in the second configuration, the panel is almost parallel to a plane of the bottom boards of the watercraft.

12 Claims, 7 Drawing Sheets

APPARATUS FOR MOVING AN OUTBOARD MOTOR INSTALLED ON A BOAT AND BOAT WITH FOLDAWAY OUTBOARD MOTOR

TECHNICAL FIELD

The present invention relates to an apparatus for moving an outboard motor installed on a boat and to a boat with foldaway outboard motor.

BACKGROUND ART

In the field of pleasure craft it is known to use small rigid watercraft or inflatable boats provided with an outboard motor, commonly called tenders, as support craft for medium or large craft. Use of the tender allows the crew and the guests of the craft to reach easily any point of the coast that instead might be precluded to the craft due to limits of maneuver, draught or restrictions due to marine orders and the like.

Obviously, these service craft, the tenders, must have the maximum possible space on board yet occupy a minimal amount of space when loaded on the craft during the navigation.

Actually, the presence of an outboard motor (which therefore protrudes with respect to the outline of the tender), the protrusion of the corresponding propeller, which is present even when the boat is not in operation, and the fact that the center of gravity of the assembly is considerably shifted toward the stern (the weight of the motor is very high and concentrated in a cantilever fashion beyond the stern), complicates significantly the operations of launching and recovering the tender. The use of the outboard motor, moreover, entails a considerable reduction in the internal occupiable surface, as a consequence of the need to accommodate lever systems, cables and other apparatuses required for the transmission of the controls of said engine from the respective control bar to a pilot post located in a more advanced position in the boat (abaft). The spaces occupied by these components are obviously not available to passengers.

In order to make hauling operations easier and in order to facilitate the housing of the tender during navigation on the craft that it serves (some crafts have an appropriate compartment for storing the tender), solutions for collapsing the transom of the tender by deflating the buoyancy chambers (watertight chambers which, inflated appropriately, constitute the sides of the boat) and other methods useful for reducing the space occupation of the outboard motor are known (all these solutions are intended to accommodate the motor, during the housing of the boat, on the bottom boards of the boat itself, minimizing overall space occupation).

These specific solutions can be applied only on so-called portable motors, of low power and with tiller steering (every small outboard motor has a tiller with a handpiece that can rotate and constitutes the speed control; the tiller is jointly connected to the outboard motor and its movement turns the motor with respect to the longitudinal axis of the boat).

These solutions for collapsing the motor do not affect the usability of the deck spaces, which remain limited, force various manual operations and are incompatible with remote controls (the cited solutions can be applied only with motors that have tiller steering).

In order to obviate these drawbacks, some shipowners adopt hydrojet tenders, i.e., tenders provided with an inboard motor and a water jet propulsion pump. This solution guarantees to eliminate the problems linked to the weight of the outboard motor cantilevered with respect to the stern and to the additional space occupation with respect to the outline of the watercraft that is typical of outboard motors, but the limitations connected to the use of the hydrojet are the limited space on board for housing personal items and equipment; because much of the space under the seats and under the console is occupied by the motor, the propulsion system and by the respective equipment.

Like all inboard motors, hydrojet motors are particularly complicated in case of maintenance and repair intervention: this is due to poor access to the motor and the poor support network that exists for these motors, which are much less widespread than the outboard units.

An inboard motor on small crafts leads to a high risk of flooding risk of the motor itself, with consequent loss of functionality and serious economic damage.

Because of the poor efficiency of hydrojet propulsion at low speed, one is forced to use motors of high power, weight, cost and complexity in order to obtain a satisfactory performance.

It is therefore evident that hydrojet motors do not solve the typical problems of outboard motors but simply reduce some of the drawbacks of the latter while creating others that in some cases are even worse.

It is noted that a tender should have the maximum people carrying capacity while also guaranteeing maximization of the usable spaces on board (a large boat would be ideal) but at the same time must have the smallest possible space occupation and weight in order to be allow to easily accommodate the tender in the limited available spaces of the main craft. It is fundamental, moreover, to be able to have a forward-shifted center of gravity, because this allows easy launching and hauling especially in yachts equipped with a garage (compartment designed for storing the tender) that use pulling winches and ascent ramps or rollers as a launching and raising apparatus.

DISCLOSURE OF THE INVENTION

The aim of the present invention is to solve the problems mentioned above by proposing an apparatus for moving an outboard motor installed on a boat that allows minimization of the space occupation of the motor, with respect to the outline of the boat on which it will be installed, when it is not used.

Within this aim, an object of the invention is to propose an apparatus for moving an outboard motor installed on a boat that allows, in a first configuration for use, to use the outboard motor and, in at least one second configuration for use, to house the motor in a specific portion of the boat. Another object of the invention is to propose a boat with foldaway outboard motor that is easy to haul/launch.

Another object of the invention is to propose a boat with foldaway outboard motor that offers a minimum overall space occupation.

Another object of the invention is to propose a boat with foldaway outboard motor that is easy to pilot.

Another object of the present invention is to provide an apparatus for moving an outboard motor installed on a boat and a corresponding boat with foldaway outboard motor that have modest costs, are relatively easy to provide in practice and are safe in use.

This aim and these and other objects that will become better apparent hereinafter are achieved by an apparatus for moving an outboard motor installed on a watercraft of the type that comprises a transom for the stable coupling of engagement elements that are jointly connected to said motor, characterized in that it comprises a panel, which is articulated at least to the bottom boards of said watercraft and at least partially superimposed on the transom, for the engagement of said engagement elements of said motor, said panel, by virtue of articulation means, being movable from a first configuration for navigation, in which it is partially superimposed on said transom and rigidly coupled thereto, to a second configuration for housing the watercraft, in which it is rotated substantially at right angles to said transom, in said second configuration said panel being almost parallel to the plane of the bottom boards of the watercraft.

This aim and these and other objects are also achieved by a boat with foldaway outboard motor of the type that comprises bottom boards delimited by sides, the outboard motor being coupled, even indirectly, to the transom of the boat, characterized in that it comprises a panel, for the coupling of said motor so that it is at least rotatably coupled, by virtue of articulation means, to at least one portion of said boat chosen between the transom and the bottom boards, said panel, by virtue of the action of said articulation means, being movable from a first configuration for navigation, in which it is partially superimposed on said transom and rigidly coupled thereto, to a second configuration for housing the boat, in which is rotated substantially at right angles to said transom, in said second configuration said panel being almost parallel to the plane of the bottom boards of the boat.

BRIEF DESCRIPTION OF THE DRAWINGS

Further characteristics and advantages of the invention will become better apparent from the following detailed description of a preferred but not exclusive embodiment of the apparatus for moving an outboard motor installed on a boat and of the corresponding boat with foldaway outboard motor according to the invention, illustrated by way of non-limiting example in the accompanying drawings, wherein.

WAYS OF CARRYING OUT THE INVENTION

Figure 1:
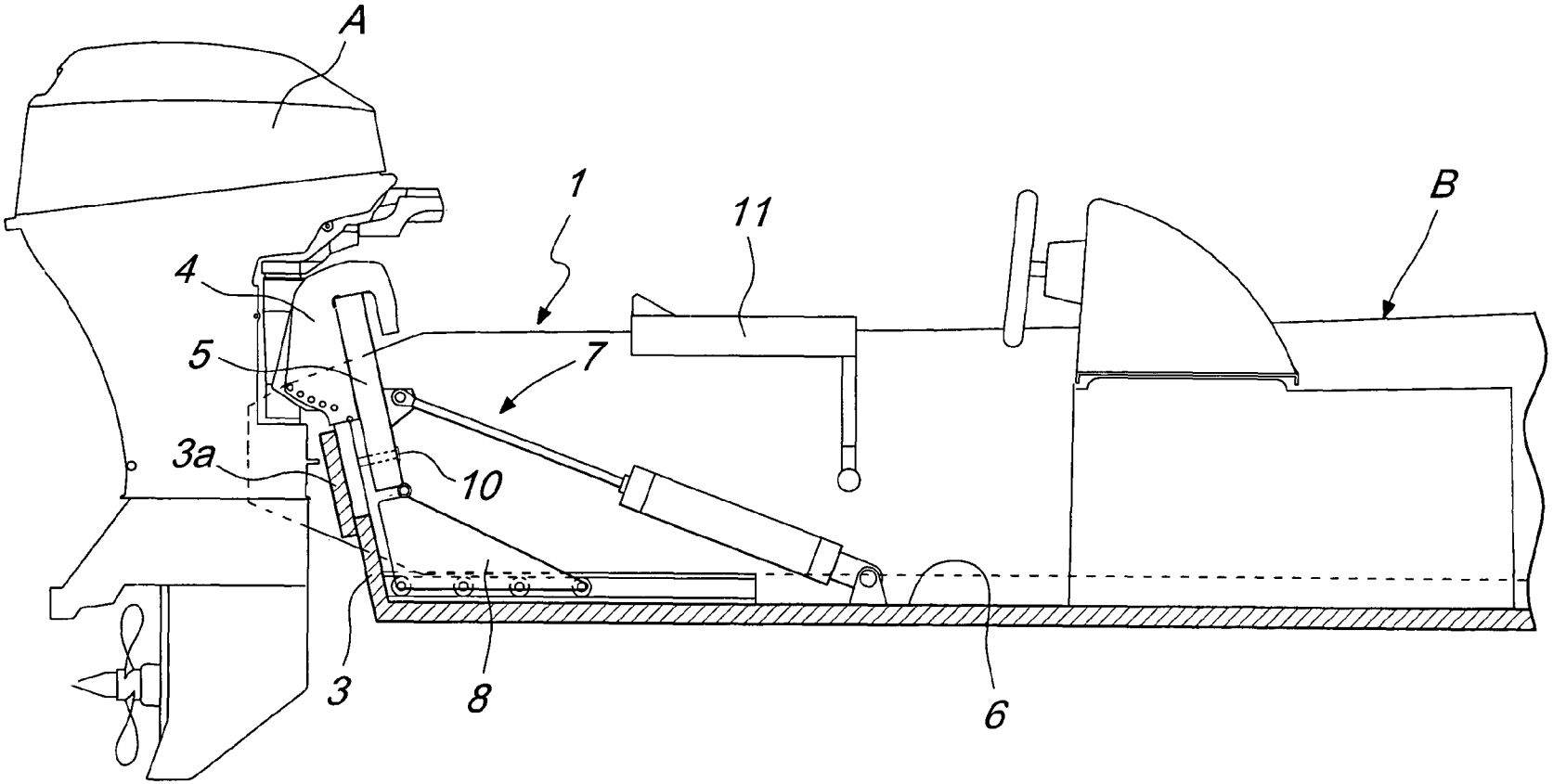
FIG. 1 is a sectional side view, taken along a longitudinal plane, of the portion of a boat on which an apparatus for moving an outboard motor according to the invention is installed, in the configuration for navigation.
Figure 2:
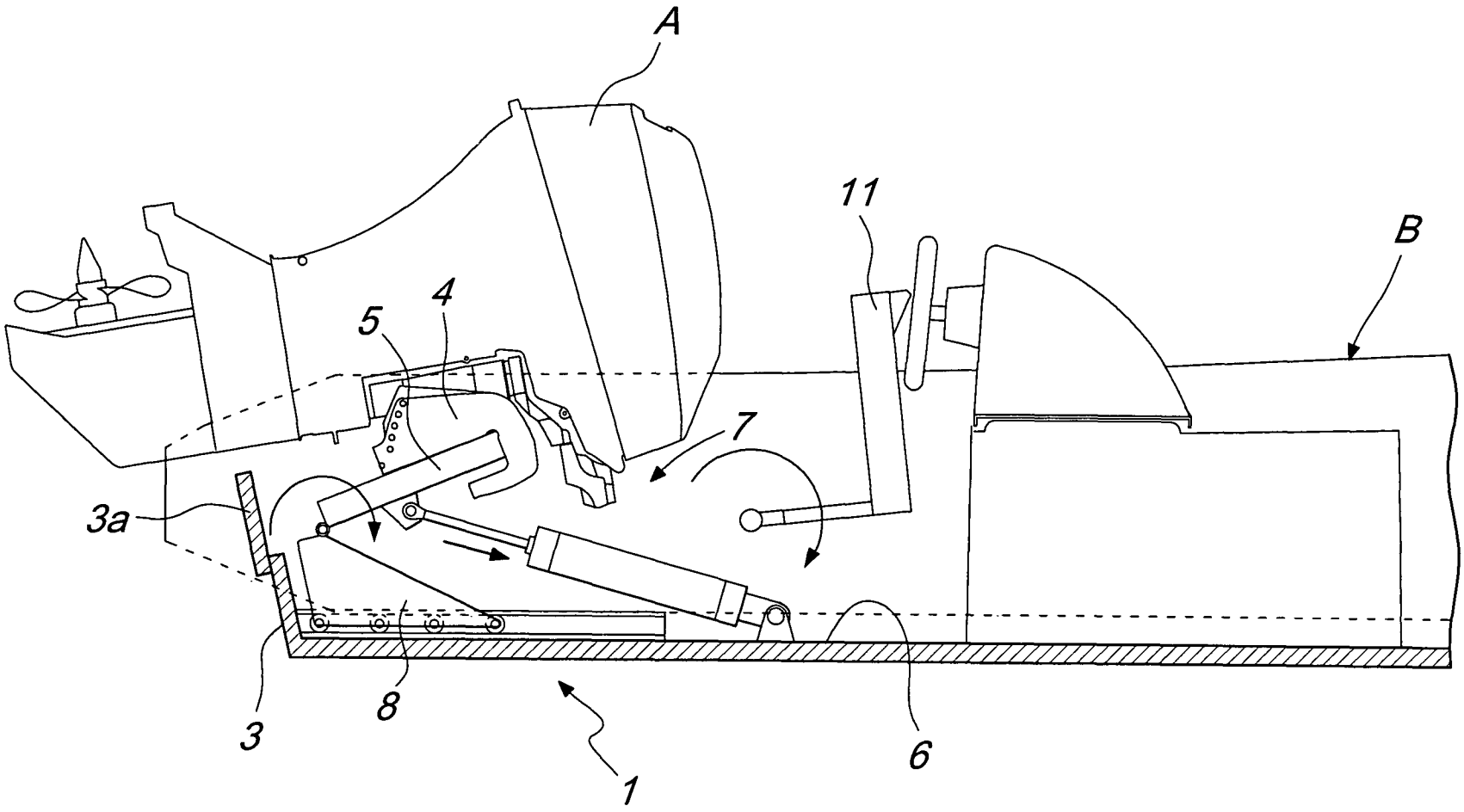
FIG. 2 is a sectional side view, taken along a longitudinal plane, of the portion of a boat on which an apparatus for moving an outboard motor according to the invention is installed, during the movement of the motor.
Figure 3:
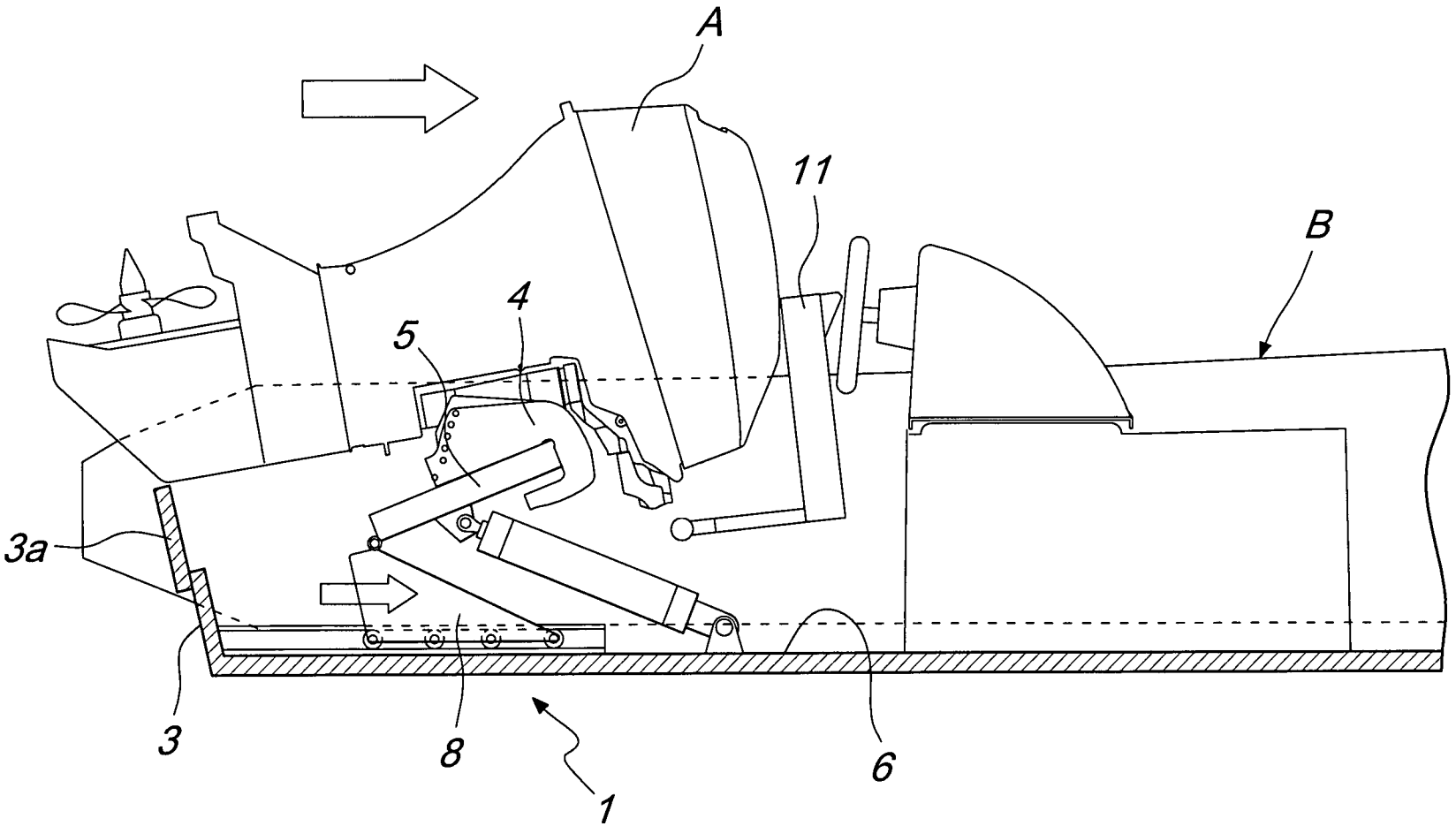
FIG. 3 is a sectional side view, taken along a longitudinal plane, of the portion of a boat on which an apparatus for moving an outboard motor according to the invention is installed, in the configuration for housing the boat.
Figure 4:
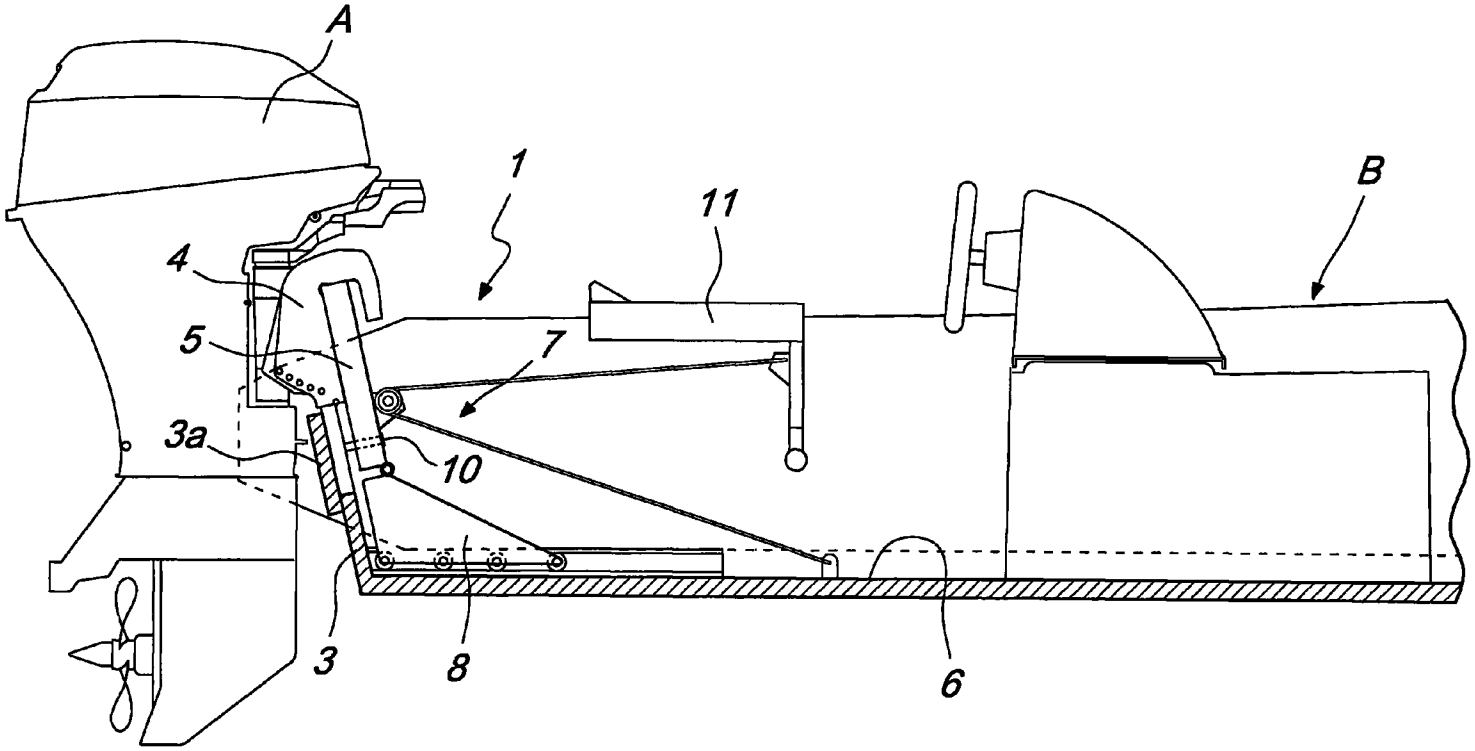
FIG. 4 is a sectional side view, taken along a longitudinal plane, of a further constructive solution related to a portion of a boat on which an apparatus for moving an outboard motor according to the invention is installed, in the configuration for navigation.
Figure 5:
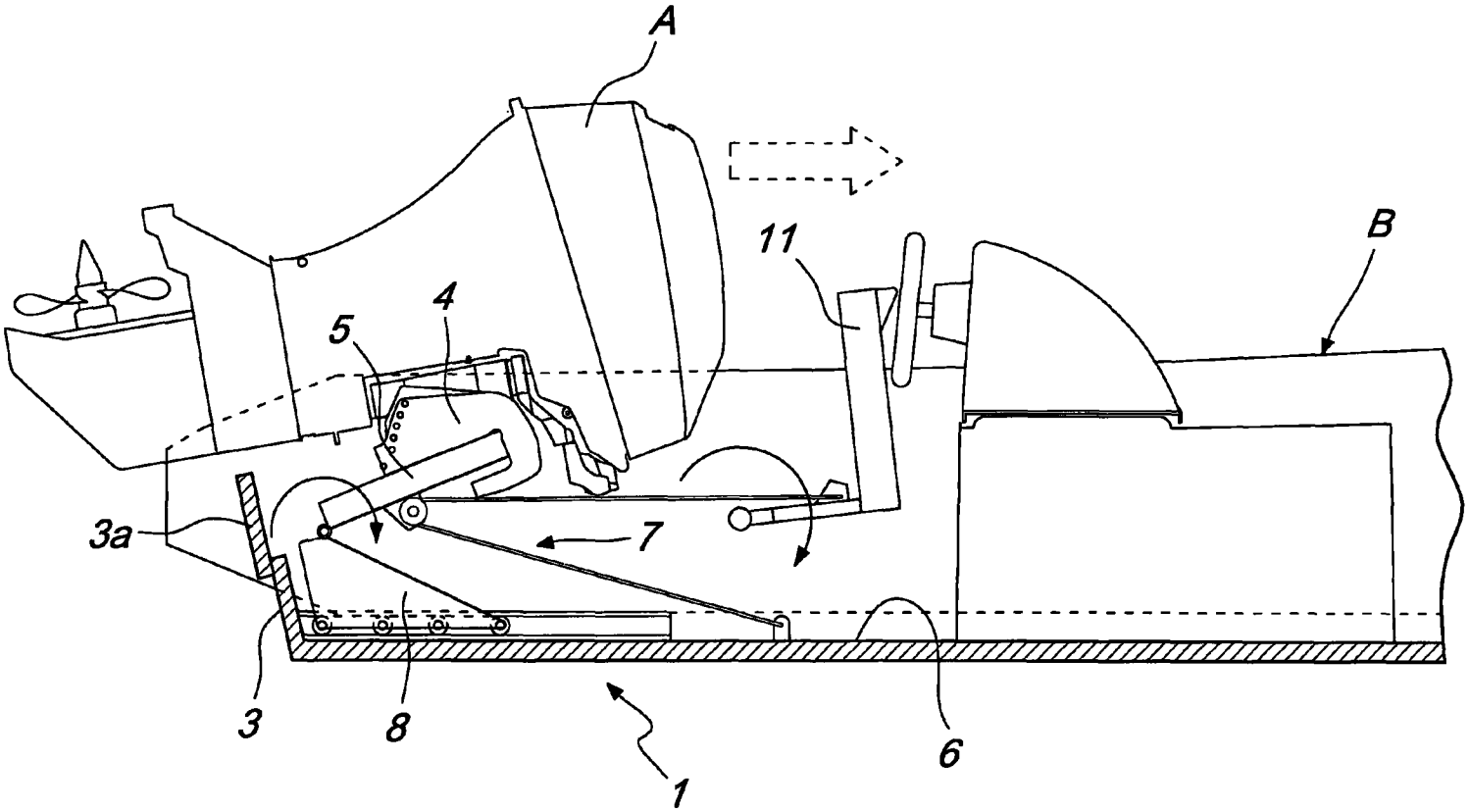
FIG. 5 is a sectional side view, taken along a longitudinal plane, of a further constructive solution related to a portion of a boat on which an apparatus for moving an outboard motor according to the invention is installed, in the configuration for housing the boat.
Figure 6:
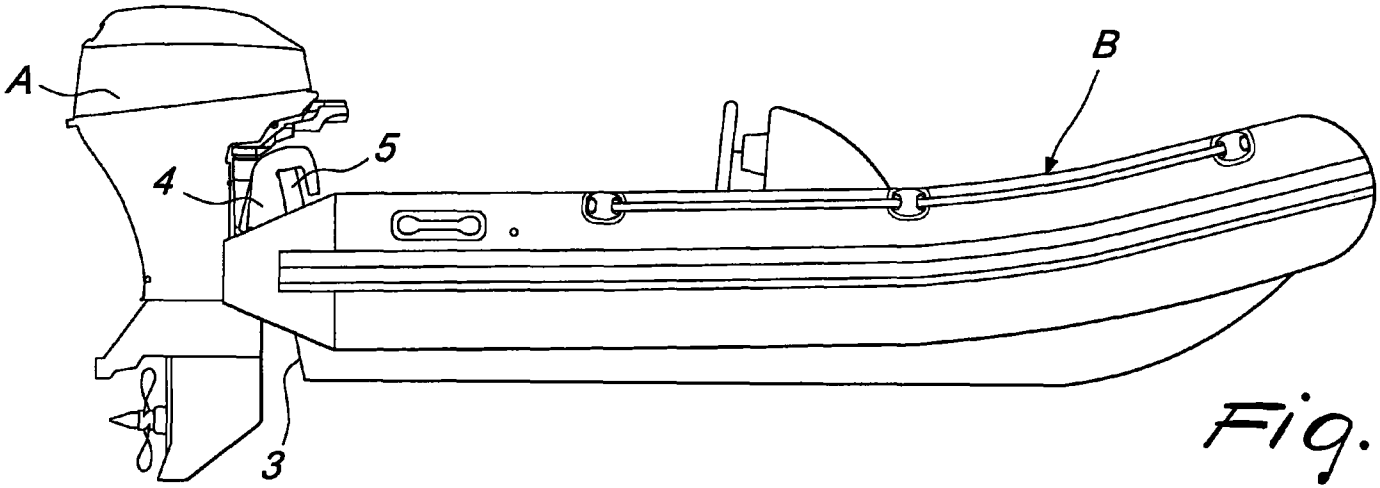
FIG. 6 is a side view of a boat on which an apparatus for moving an outboard motor according to the invention is installed, in the configuration for navigation.
Figure 7:
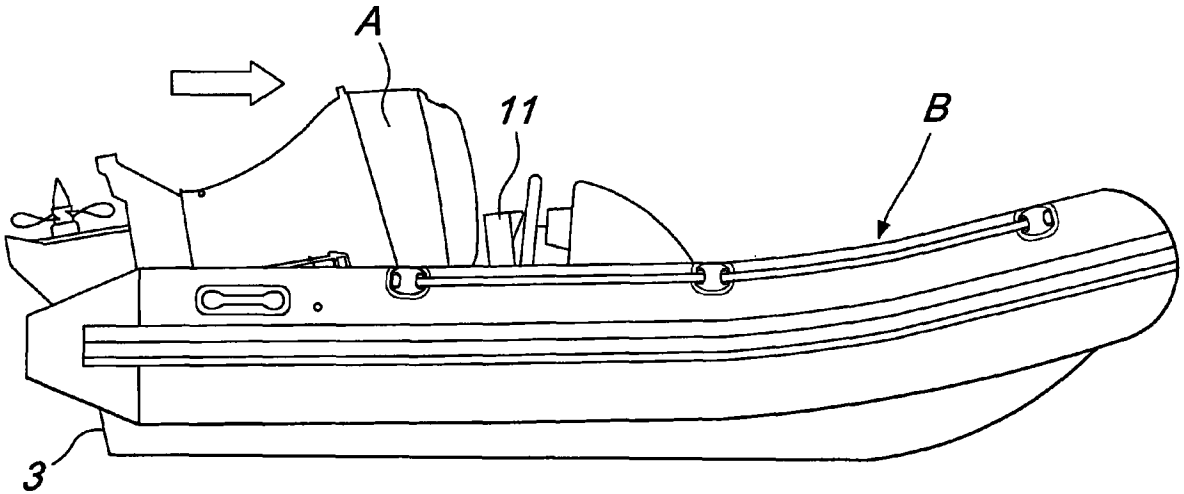
FIG. 7 is a side view of a boat on which an apparatus for moving an outboard motor according to the invention is installed, in the configuration for housing the boat.
Figure 8:
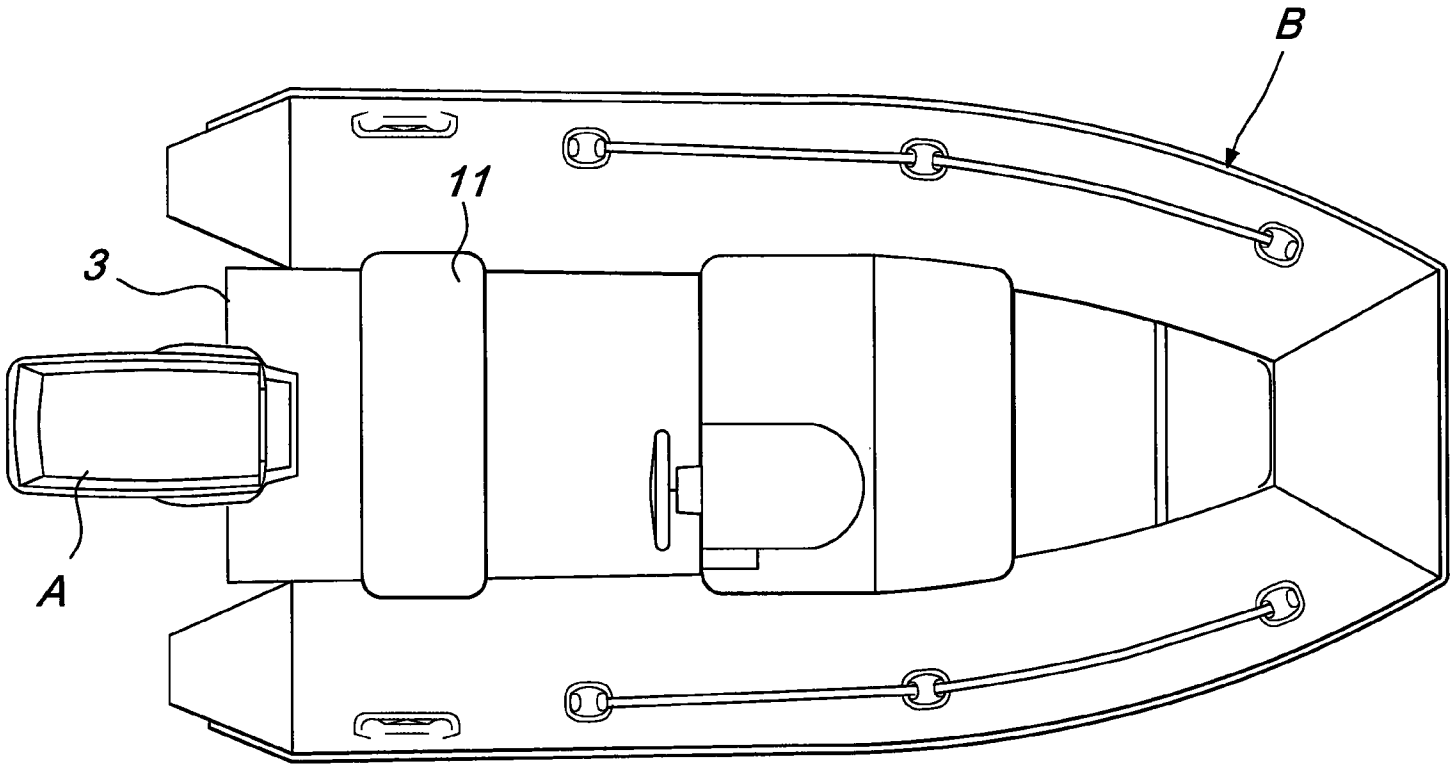
FIG. 8 is a top view of a boat on which an apparatus for moving an outboard motor according to the invention is installed, in the configuration for navigation.

With reference to the figures, the reference numeral 1 generally designates an apparatus for moving an outboard motor A installed on a boat B.

The apparatus 1 must be installed preferably on a boat B, provided with an outboard motor A, the boat B being preferably of the type that comprises a transom 3 for the stable coupling of appropriate engagement elements 4 jointly connected to the motor A.

The apparatus 1 comprises a panel 5, which is articulated at least to the bottom boards 6 (understood, in nautical terms, as the walkable surface of the watercraft) and is at least partially superimposed on the transom 3; the panel 5 allows the engagement of the engagement elements 4 of the motor A.

The panel 5, by virtue of the action of appropriate articulation means 7, can move from a first configuration for navigation, in which it is partially superimposed on the transom 3 and rigidly coupled thereto, to a second configuration for housing the boat, in which it is rotated substantially at right angles to the transom 3: when it is in the second configuration, the panel 5 is substantially close to a parallel arrangement with respect to the plane of the bottom boards 6 of the watercraft.

According to a preferred embodiment, of unquestionable interest in practice and in application, the articulation means 7 comprise at least one slider 8, which can slide on appropriate respective tracks coupled to the bottom boards 6: the slider 8 has at least one upper hinge 9, with which the panel 5 is associated.

When the apparatus 1 is arranged in the first configuration for navigation, the hinge 9 keeps the panel 5 substantially superimposed on the transom 3, with the slider 8 arranged along the tracks proximate to the transom 3.

When instead the apparatus 1 is arranged in the second configuration for housing the boat, the panel 5 is rotated, about the hinge 9, and displaced toward the stem, as a consequence of a translation movement toward the stem of the slider 8 along the respective tracks.

One can deduce that when the apparatus 1 is in the first configuration, the motor A is in conditions of optimum alignment for correct navigation; when the device is in the second configuration, the motor A is reclined onto the bottom boards, minimizing its space occupation with respect to the outline of the boat: it is evident that in this second configuration it will be easier to store the boat in a suitable compartment designed for the storage thereof and the launching and hauling operations will be easier because the motor A will not be in a cantilevered arrangement with respect to the outline of the boat but will be moved toward the stem and thus the overall center of gravity of the watercraft and the motor A will be proximate to the centerline of said boat (causing an increase in maneuverability by means of winches and the like of the boat when the apparatus 1 and the motor A are in the second configuration).

Obviously, in order to increase the stability and safety of the apparatus 1, the apparatus comprises assemblies for coupling the panel 5 and the slider 8 in each one of the configurations, the first one for navigation and the second one for housing the watercraft. In particular, the possibility is noted to provide the panel 5 with guiding bushes and respective pivots 10 designed to lock the panel 5 to the transom 3. The use of other coupling assemblies, possibly even servo-actuated for full. automation of operation, is not excluded.

According to a constructive solution that is alternative to the preceding one and is also of some interest in application and assuredly effective, the articulation means 7 comprise mutually hinged bands: of these bands, at least one first one is pivoted to the bottom boards 6 of the watercraft and at least one second band is instead pivoted to the panel 5. The bands, the panel 5 and the bottom boards 6 are mutually arranged like an articulated parallelogram (or more generically like an articulated quadrilateral) and thus have all the geometric and mechanical (kinematic and dynamic) characteristics thereof.

In practice, the panel 5 can move because it is conveniently pivoted to a band that can perform a translational motion and optionally rotate according to a preset rule of motion. It should be noted that in applied mechanics, the articulated parallelogram is a system of four rigid rods whose length is equal in pairs and which are mutually connected only by hinges, so that regardless of the position assumed by the system the corresponding pairs of rigid rods are always parallel to each other. If the length of the rods allows two of them to perform complete rotations about the hinges of the rod that is kept stationary, the rotating rods are termed cranks; if the rotation is allowed only through an angle of less than 360°, they are termed rockers. The articulated parallelogram is a particular case of the articulated quadrilateral that has four different rods and four hinges. A system thus conceived designed is termed planar, because regardless of the position assumed by the rods, said rods move always on a plane that is normal to the axes of the hinges.

In this case also, therefore, the bands must comprise appropriate coupling apparatuses for locking in the first and second configurations the panel 5 and said bands.

In general (regardless of the constructive solution chosen), the articulation means advantageously comprise appropriate actuators in order to automate their movement between the first configuration and the second configuration.

More specifically, it is noted that the actuators are positively controlled by an appropriate control and management unit designed for their activation: said unit may comprise specific activation apparatuses, which may also be of the remote type.

It is therefore possible to pass from the first configuration to the second configuration simply by operating a remote control: this allows to lower the boat into the water while it is still in the second configuration (considering that the panel 5 also is superimposed on the transom 3, although said transom has a lower height than needed during navigation) and operate the remote control in order to bring it to the first configuration and thus make it suitable for navigation.

The limited height of the transom 3 should not be a concern during the hauling and launching step, because in these conditions the boat is completely unladen (there are no passengers and there is no load to be transported) and thus its waterline (its freeboard) is undoubtedly on a different level than when it is fully laden: accordingly, the height of the transom 3 is in this case more than sufficient to avoid the entry of the water.

In any case, attention is called to the possibility to use a screen 3*a* made of elastically deformable material, which by surmounting the transom 3 constitutes a barrier in order to avoid the entry of water, particularly to hinder the access of waves.

It should be noted that the actuators are preferably chosen among those of the electric, hydraulic and pneumatic type and among combinations thereof.

The provision of the apparatus 1 with which to modify existing watercrafts is only one of the possible applications of the present invention: it is in fact advantageously possible to provide boats B that have movement of the motor A from a first configuration for navigation to a second configuration for housing.

In this case, the boat B with outboard motor A of the "foldaway" type comprises the resting plane termed bottom boards 6 that is delimited by a plurality of lateral walls, called sides, of which the front one is the bow, the sides are the lateral ones and the stern one is the quarter, which ends with a transom 3: the outboard motor A is generally coupled, even indirectly, to the transom 3.

The boat B comprises a panel 5, for the coupling of the motor A, which is at least rotatably coupled, by virtue of appropriate articulation means 7, to at least one portion of the boat B chosen between the transom 3 and the bottom boards 6.

The panel 5, by virtue of the action of the articulation means 7, can move from a first configuration for navigation, in which it is partially superimposed on the transom 3 and rigidly coupled thereto, to a second configuration for housing the boat, in which is rotated substantially at right angles to the transom 3.

When the panel 5 is in the second configuration it is almost parallel to the plane of the bottom boards 6 of the boat B.

It should be specified that according to a particular constructive solution, the, boat B comprises at least one track which is jointly connected to the bottom boards 6 for the sliding engagement of a slider 8, which constitutes one of the articulation means 7: the slider 8 has at least one upper hinge 9 with which the panel 5 is associated.

When the panel is in the first configuration for navigation, the hinge 9 keeps the panel 5 substantially superimposed on the transom 3 with the slider 8 arranged along the tracks proximate to the transom 3; when it is in the second configuration for housing the boat B, the panel 5 is rotated, about the hinge 9, and moved forward toward the stem following a translation movement toward the stem of the slider 8 along the corresponding tracks.

According to a different constructive solution, the articulation means 7 of the boat B can comprise mutually hinged bands, of which at least one first band is pivoted to the bottom boards 6 of the boat B and at least one second band is pivoted to the panel 5. The bands, the panel 5 and the bottom boards 6 are mutually arranged like an articulated quadrilateral or like an articulated parallelogram.

In any case, for any possible constructive solution, the articulation means 7 must comprise appropriate coupling devices in order to lock the panel 5 in the first configuration and in the second configuration.

According to an application that increases the space available for the users of the boat B, said boat comprises at least one bench 11 in order to accommodate the users of the boat B. The bench 11 is arranged in a position for normal use when the panel 5 is arranged in the first configuration for navigation and is arranged in a forward position, moved at least partially toward the stern, when the panel 5 is arranged in the second configuration for housing, in which the motor A is substantially rested on the bottom boards 6 so as to be partially superimposed on the region occupied by the bench 11 during navigation.

The present invention allows to provide a rigid boat and/or a semirigid inflatable boat B provided with outboard motor A that can assume two different configurations.

Configuration 1: navigation trim, with the outboard motor A in navigation position.

Configuration 2: housing or storage trim, with the outboard motor A accommodated inside the boat B.

In the configuration 2, the space occupation is reduced drastically in height and in length and at the same time the center of gravity of the assembly is moved more toward the bow, so that, together with the fact that the protrusions of the propeller are eliminated, the operations for launching and raising the boat B on board the main craft are facilitated.

The space occupied by the motor A in configuration 2 can be used by the passengers in configuration 1, since it is possible to arrange on it a movable bench 11, which can be connected to the other moving parts by virtue of cables, tension elements, arms or springs (for example of the gas-operated type).

A watercraft (boat B) is thus obtained which has all the typical advantages of the outboard motor A, i.e., ease of assistance and repair, minimization of the risk of flooding of the motor A, high performance even at low speed (by virtue of the propeller-based propulsion) and thus a lower power requirement and a lower weight than a hydrojet motor, a large space for the storage of personal items and equipment. The boat B also has many advantages typical of hydrojet models, i.e., reduced space occupation, forward-shifted center of gravity, larger occupiable spaces, without however having the typical limitations, i.e., great weight, complexity, limited spaces for housing objects and equipment, and high cost.

When the motor is placed in the navigation trim (i.e., in configuration 1), a considerable elongation of the boat occurs, fully to the advantage of its nautical quality/performance, such as maneuverability and stability, and the occupiable space on board also increases.

With respect to a normal boat, the engagement elements 4 of the motor A, by means of trucks and/or hinges, pivots and the like (as indicated in the two exemplifying constructive solutions described previously) can be moved and/or reclined toward the inside of the boat, thus obtaining that the outboard motor A, too, moves and/or rotates until it folds away, at least partially, within the outline of the boat.

The maneuver can occur preferably by means of one or more electrohydraulic or electromechanical pistons (the actuators described earlier), which can be actuated, if required, also by means of an appropriate remote control.

This last option is particularly useful for the following reasons:

- the change of configuration occurs in complete safety, because it can be performed without people on board;
- when the boat B is not loaded with the weight of the occupants, it is less submerged and thus has a higher freeboard, minimizing the risks of water entry from the opening that remains open in the transom 3 during the change of configuration.

Great breadth of movement of the motor A and reduced space occupation of the moving parts are facilitated by the use of a remote rudder control system of the hydraulic type, i.e., without rigid cables.

The motor A in configuration 2 can be concealed under an optional movable housing, as an alternative to the bench 11; said housing, when one is in configuration 1, can be used as a driving seat, thus providing more accommodation.

In this case, the aesthetic appearance of the boat, more similar to a jet ski, is modified substantially as well.

The sequence of use is as follows:

1. tender (boat B) on board the main craft in configuration 2 (compact, thus with reduced space occupation);
2. launching of the tender in configuration 2 (operations facilitated by the forward-shifted center of gravity);
3. activation of the remote control in order to shift from configuration 2 to configuration 1 (the housing automatically repositions itself and acts as a bench 11 for sitting or central seat);
4. boarding of the passengers;
5. use of the tender in the water in configuration 1 (navigation trim);
6. disembarking of the passengers from the tender in order to board the vessel again, in navigation trim;
7. restoration, by virtue of the remote control, of configuration 2 (compact);
8. recover of the tender in configuration 2 (compact and with forward-shifted center of gravity) on board the craft.

Viewing the automatic sequence of operations performed by remote control will be, moreover, assuredly theatrically effective.

By way of non-limiting example, two different methods of embodiment are discussed hereinafter.

EXAMPLE 1

The function of supporting the motor is performed by the panel 5, which can be made of wood, metal or composite, with the possibility to move along the longitudinal axis of the hull and at the same time rotate forward, its fulcrum of rotation being lower than the resting of the motor A.

This is possible by virtue of the fact that the panel 5 is coupled in the lower part to a hinge 9, acting as a fulcrum; the panel 5 and its fulcrum (hinge 9) can be fixed to a slider 8, which can slide along the longitudinal axis of the boat B, watercraft and the like.

Thus, the rotation of the panel 5 allows a lowering and forward movement of the outboard motor A, while the slider 8 allows a further possibility of translation.

The rotation of the panel 5 and the entrainment of the slider 8 can be performed by a single electric actuator or hydroelectric actuator. This does not exclude the use, if preferred, of a plurality of mutually controlled actuators.

If required, by connecting the slider 8, by virtue of an arm or tension elements or gas cylinder actuators, to a housing or sitting surface (bench 11), it is possible to move or turn it simultaneously and automatically with respect to the movement of the motor A. This does not exclude the use, if preferred, of multiple actuators or manual actuation assemblies.

The panel 5 can be locked to the hull in adapted abutments and kept in the navigation position by virtue of guiding bushes and pivots 10 or other mechanical guiding and/or locking systems to aid the function performed by the electrohydraulic actuator.

In the case of particularly heavy motors, gas cylinder actuators can be used in aid of the hydraulic actuator, in order to remove load from said actuator, and also damp the movements, making them more linear.

It should be noted that the movement can be obtained by a single action: forward motion of the motor, rotation of the motor.

The extent of the forward motion is preset by the length of the tracks of the slider 8 (means for reduced friction, such as rollers, balls, wheels or sliding blocks made of self-lubricating material, can be interposed between the slider 8 and the track); the rotation and consequent lowering are caused by the stroke of the actuator and by the distance between the fulcrum (hinge 9) and the panel 5 (particularly of the position for engaging the motor A to the panel 5).

According to the result that one wishes to obtain, it is possible to provide the apparatus 1 by using the forward movement and rotation in combination with each other or individually.

If necessary, the use of a bulkhead (a screen made of elastically deformable material 3*a*) allows, during the operations for transition between configurations 1 and 2, to limit the risks of flooding by virtue of the fact that the upper edge of said bulkhead is higher than the waterline.

EXAMPLE 2

In order to obtain the same results obtained with what has been described in example 1, it is possible to use an apparatus 1 that uses, for moving the panel 5, a series of arms (bars) that form a sort of articulated parallelogram/quadrilateral, which is variable, i.e., deformable, by virtue of joints (hinges) that act as a fulcrum and optionally by virtue of guides.

By acting on the parallelogram, by changing its angles one obtains simultaneously a lowering and a forward motion of the outboard motor A with respect to the hull: the deformation of the parallelogram can be performed by one or more electric or electrohydraulic actuators.

The extent of the movement, is determined in this case by the size of the parallelogram itself and by the stroke of the actuator.

In this case also, collapsible housings and/or benches 11 can be present which can be actuated in a manner similar to what has already been described for the preceding example.

The advantages of the invention are substantially the following.

Advantages with respect to a boat provided with an outboard motor A coupled in a standard manner:

1. in the first configuration for navigation:
   - more space on board for occupants
   - greater length of the hull, with consequent improvement of nautical qualities
2. in the second configuration for housing/storage of the boat:
   - less space occupation in length and height
   - more forward position of the center of gravity, which facilitates launching and hauling operations
   - more compact appearance Advantages with respect to a boat provided with a hydrojet motor:

1. in the first configuration for navigation:
   - more space on board for storing equipment and personal items
   - good performance with reduced power
   - reduced consumption
   - minimization of the risks of flooding the motor
2. in the second configuration for storage/housing of the boat:
   - reduced weight
   - easy assistance and maintenance and reduction of consequent costs
   - possibility to perform assistance and/or resell separately the motor and the boat.

Advantageously, the apparatus 1 for moving an outboard motor A installed on a boat according to the invention allows to minimize the space occupation of the motor A with respect to the outline of the boat on which it is installed when it is not being used.

Usefully, the apparatus 1 according to the invention allows, in a first configuration for use, the use of the outboard motor A and, in at least one second configuration for use, the housing of the motor A in a specific portion of the installation boat.

Positively, the boat B with foldaway outboard motor A is easy to haul/launch.

The fact that the boat B according to the invention has a reduced overall space occupation is also undoubtedly an improvement.

Moreover, the fact that the boat B according to the invention is easy to pilot is a great improvement with respect to the background art.

The invention thus conceived is susceptible of numerous modifications and variations, all of which are within the scope of the accompanying claims; all the details may furthermore be replaced with other technically equivalent elements.

In the exemplary embodiments shown, individual characteristics, given in relation to specific examples, may actually be interchanged with other different characteristics that exist in other exemplary embodiments.

Moreover, it is noted that anything found to be already known during the patenting process is understood not to be claimed and to be the subject of a disclaimer.

In practice, the materials used, as well as the dimensions, may be any according to the requirements and the state of the art.

The invention claimed is:

1. A semirigid inflatable watercraft including an outboard motor installed thereon and an apparatus for moving the outboard motor, the watercraft comprising bottom boards forming a walkable surface of said watercraft, and a transom extending upwardly from the bottom boards, the apparatus for moving the outboard motor comprising a panel, which is slidably connected and rotatably articulated to the bottom boards at a position adjacent to said transom, said apparatus further including engagement elements supporting said motor, wherein said panel, by virtue of articulation means being slidably connected and rotatably articulated to the bottom boards, being movable from a first configuration for navigation, wherein said panel is partially superimposed on said transom and extending upwardly therefrom and rigidly coupled thereto, to a second configuration for housing the watercraft, wherein said panel is rotated substantially at right angles to said transom, in said second configuration said panel being substantially parallel to a plane of the bottom boards of the watercraft.

2. The semirigid inflatable watercraft including an outboard motor installed thereon according to claim 1, wherein said articulation means comprise at least one slider, which can slide on respective tracks rigidly coupled to the bottom boards and has at least one upper hinge with which said panel is associated, in said first configuration for navigation said hinge keeping said panel substantially superimposed on said transom with said slider arranged along the tracks proximate to said transom, in said second configuration for housing the watercraft said panel being rotated, about said hinge, and moved forward toward the stem, following a translational motion toward stem of said at least one slider along the respective tracks.

3. The semirigid inflatable watercraft including an outboard motor installed thereon according to claim 2, further comprising assemblies for coupling the panel and the slider in each one of said configurations, the first one for navigation and the second one for housing the watercraft.

4. The semirigid inflatable watercraft including an outboard motor installed thereon according to claim 1, wherein said articulation means comprise mutually hinged bands, of which at least one first band is pivoted to the bottom boards of the boat and at least one second band is pivoted to said panel, said bands, said panel and said bottom boards being mutually arranged like a device chosen between an articulated quadrilateral and an articulated parallelogram.

5. The semirigid inflatable watercraft including an outboard motor installed thereon according to claim 1, wherein said bands comprise coupling apparatuses for locking said panel in said first configuration and said second configuration.

6. The semirigid inflatable watercraft including an outboard motor installed thereon according to claim 1, wherein said articulation means comprise actuators for automating their movement between said first configuration and said second configuration.

7. The semirigid inflatable watercraft including an outboard motor installed thereon according to claim 6, wherein said actuators are controlled by a control and management unit designed for their activation, said unit comprising activation devices, even of the remote type.

8. The semirigid inflatable watercraft including an outboard motor installed thereon according to claim 6, wherein said actuators are chosen among those of the electric, hydraulic and pneumatic type and among combinations thereof.

9. A watercraft with foldaway outboard motor of the type that comprises bottom boards delimited by sides, the outboard motor being coupled, even indirectly, to a transom of the watercraft, further comprising a panel, for the coupling of said motor, which is at least rotatably coupled, by virtue of articulation means, to at least one portion of said watercraft chosen between the transom and the bottom boards, said panel, by virtue of the action of said articulation means, being movable from a first configuration for navigation, in which is partially superimposed on said transom and rigidly coupled thereto, to a second configuration for housing the watercraft, in which is rotated substantially at right angles to said transom, in said second configuration said panel being almost parallel to the plane of the bottom boards of the watercraft, further comprising at least one bench for accommodating users of the watercraft, said bench being arranged in a position for normal use when said panel is arranged in said first configuration for navigation and being arranged in a forward-shifted position, at least partially moved toward the stern, when said panel is arranged in said second configuration for housing, in which said motor is substantially rested on said bottom boards so as to be partially superimposed on the region occupied by the bench during navigation.

10. The boat according to claim 9, further comprising at least one track which is jointly connected to said bottom boards for the sliding engagement of at least one slider that constitutes one of said articulation means, said slider being provided with at least one upper hinge with which said panel is associated, in said first configuration for navigation said hinge keeping said panel substantial superimposed on said transom with said slider arranged along the tracks proximate to said transom, in said second configuration for housing the boat said panel being rotated, about said hinge, and moved forward toward the stem following a translational motion toward the stem of said at least one slider along the respective tracks.

11. The boat according to claim 9, wherein said articulation means comprise mutually hinged bands, of which at least one first band is pivoted to the bottom boards of the boat and at least one second band is pivoted to said panel, said bands, said panel and said bottom boards being mutually arranged like a device chosen between an articulated quadrilateral and an articulated parallelogram.

12. The boat according to claim 10, wherein said articulation means comprise coupling apparatuses for locking said panel in said first configuration and said second configuration.

* * * * *